US008365470B1

(12) United States Patent
Campbell et al.

(10) Patent No.: US 8,365,470 B1
(45) Date of Patent: Feb. 5, 2013

(54) LEAD SCREW OPERATOR

(76) Inventors: Frank W. Campbell, Lake Elmo, MN (US); John J. Micinski, Rockford, IL (US)

( * ) Notice: Subject to any disclaimer, the term of this patent is extended or adjusted under 35 U.S.C. 154(b) by 664 days.

(21) Appl. No.: 12/044,377

(22) Filed: Mar. 7, 2008

(51) Int. Cl.
*E05F 11/24* (2006.01)

(52) U.S. Cl. ..... 49/343; 49/246; 49/341

(58) Field of Classification Search ..... 49/246, 49/247, 248, 249, 250, 252, 253, 341, 343; 74/89.37, 89.39, 424.78; 296/56
See application file for complete search history.

(56) References Cited

U.S. PATENT DOCUMENTS

| | | | | |
|---|---|---|---|---|
| 1,171,979 | A | 2/1916 | Rixson | |
| 1,179,963 | A | 4/1916 | Rixson | |
| 1,289,828 | A | 12/1918 | Lea | |
| 1,409,459 | A | 3/1922 | Ludlow | |
| 1,423,817 | A | 7/1922 | Pitz et al. | |
| 1,444,393 | A | 2/1923 | Schonfield | |
| 1,456,468 | A | 5/1923 | Schonfield | |
| 1,570,232 | A | 1/1926 | Dyer | |
| 1,619,167 | A * | 3/1927 | Tuomi | 49/80.1 |
| 1,622,385 | A | 3/1927 | Klein | |
| 1,692,843 | A | 11/1928 | King | |
| 1,902,266 | A | 3/1933 | Ripp | |
| 1,916,817 | A | 7/1933 | Terhune | |
| 1,932,938 | A | 10/1933 | Ripp | |
| 2,033,832 | A | 3/1936 | Kelly | |
| 2,072,468 | A | 3/1937 | Saur et al. | |
| 2,166,710 | A | 7/1939 | Axe | |
| 2,182,574 | A | 12/1939 | Anchilowitz | |
| 2,252,634 | A | 8/1941 | Justason | |
| 2,366,613 | A * | 1/1945 | Hagstrom | 49/252 |
| 2,585,122 | A | 2/1952 | Hartman | |
| 2,636,727 | A * | 4/1953 | Toth | 49/80.1 |
| 2,709,582 | A | 5/1955 | Chapman | |
| 2,717,778 | A | 9/1955 | Christy | |
| 2,720,292 | A | 10/1955 | Roberts | |
| 2,778,630 | A | 1/1957 | Pearson | |
| 2,814,483 | A | 11/1957 | Bentley | |
| 2,817,978 | A | 12/1957 | Kennedy, Sr. et al. | |
| 3,139,276 | A | 6/1964 | Hay | |
| 3,210,807 | A | 10/1965 | Wallmann | |
| 3,508,449 | A * | 4/1970 | Kraina | 74/89.37 |
| 3,792,619 | A | 2/1974 | Cannon et al. | |
| 3,858,452 | A * | 1/1975 | Gatland et al. | 74/424.78 |
| 3,881,575 | A | 5/1975 | Manaugh | |
| 4,497,135 | A * | 2/1985 | Vetter | 49/280 |
| 4,823,508 | A * | 4/1989 | Allen | 49/252 |
| 4,860,493 | A * | 8/1989 | Lense | 49/279 |
| 4,866,882 | A | 9/1989 | Cappello | |
| 4,887,392 | A | 12/1989 | Lense | |
| 5,195,935 | A | 3/1993 | Fencel | |
| 5,442,879 | A | 8/1995 | Christensen | |
| 5,452,543 | A * | 9/1995 | VonWald et al. | 49/346 |
| 5,493,813 | A * | 2/1996 | Vetter et al. | 49/341 |

(Continued)

*Primary Examiner* — Katherine W Mitchell
*Assistant Examiner* — Catherine A Kelly
(74) *Attorney, Agent, or Firm* — IPLM Group, P.A.

(57) ABSTRACT

A lead screw window operator (100) utilizes a lead screw (110) that is in tension whether the operator is being used to open or close a window assembly (10). The lead screw window operator (100) may include a nut (170) that has edges sufficiently close to first and second support surfaces to prevent excess rotation of the nut (170). Also, the lead screw (110) may have a splined end to operatively connect to a first gear that has a splined profile to allow the gear to slide along the lead screw along a longitudinal axis.

14 Claims, 9 Drawing Sheets

U.S. PATENT DOCUMENTS 5,507,120 A * 4/1996 Current ..... 49/340
5,689,994 A * 11/1997 Nagai et al. ..... 74/89.32
5,826,377 A * 10/1998 Simson et al. ..... 49/362
6,244,660 B1 * 6/2001 Yoshimatsu ..... 297/344.1
6,314,681 B1 * 11/2001 Moody ..... 49/343
6,606,920 B2 8/2003 Hawkins et al.
7,013,604 B1 3/2006 Moody et al.
7,494,183 B2 * 2/2009 Liu ..... 297/284.4
2003/0110701 A1 6/2003 Dawson

* cited by examiner

LEAD SCREW OPERATOR

BACKGROUND OF THE INVENTION

1. Field of the Invention

This invention relates generally to a lead screw operator and more particularly to a lead screw operator that may be made of plastic and/or a lead screw operator that has a sliding fit with a gear that drives the lead screw operator.

2. Description of the Prior Art

Lead screw operators have been used in conjunction with windows for some time. However, because of the pressures that are exerted on the lead screw operator, the lead screw operator has typically been made of metal to accommodate the stresses. This in turn leads to higher costs.

In addition, when lead screws are utilized in operators, there is typically some longitudinal movement in the operator as the window is being moved from the open to the closed position or vice versa. While this longitudinal movement may not be extremely lengthy, there is some movement which is typically necessary for manufacturing tolerances. This brings up the problem of having a good connection between the lead screw and the gear that is driving the lead screw. This becomes problematic when the lead screw is moving in a longitudinal direction.

The present invention addresses the problems associated with the prior art lead screw operators and provides for a lead screw that may be made of plastic and also a lead screw that has a sliding fit with its drive gear.

SUMMARY OF THE INVENTION

In one embodiment, the invention is a lead screw window operator for moving a window sash between an open and closed position relative to a fixed window frame. The lead screw window operator includes a lead screw support structure and a lead screw operatively supported on the lead screw support structure. The lead screw has a longitudinal axis. The lead screw has a first collar operatively connected to a first end of the lead screw and a second collar operatively connected to a second end of the lead screw. The collars have an inside edge. A nut is positioned around the lead screw, wherein rotation of the lead screw results in movement of the nut along the longitudinal axis of the lead screw. The lead screw support structure has first and second cavities to receive the first and second collars. The cavities each having an inside stop wall, wherein clearance movement of the lead screw in either direction along the longitudinal axis always places the lead screw in tension when the inside edges contact the inside stop walls.

In another embodiment, the invention is a lead screw window operator for moving a window sash between an open and closed position relative to a fixed window frame. The lead screw window operator includes a lead screw support structure and a lead screw operatively supported on the lead screw support structure. The lead screw has a longitudinal axis. A nut is positioned around the lead screw, wherein rotation of the lead screw results in movement of the nut along the longitudinal axis of the lead screw. The nut has a front edge and a back edge, both edges generally parallel to the longitudinal axis. The lead screw support structure has a generally planar base and a first support surface extending upward from the base and generally parallel to the longitudinal base. The first support surface is positioned proximate to one of the edges. A second support surface extends upward from the base and generally parallel to the longitudinal axis, the second support surface positioned proximate the other of the edges sufficiently close which, along with the first support surface prevents rotation of the nut to 2 degrees or less.

In another embodiment, the invention is a lead screw window operator for moving a window sash between an open and closed position relative to a fixed window frame. The lead screw window operator includes a lead screw support structure and a lead screw operatively supported on the lead screw support structure. The lead screw has a longitudinal axis. A splined end is operatively connected to the first end of the lead screw, the splined end having a plurality of splines. A first gear is operatively connected to an input cranking member, the first gear having first end and a second end. The first end has a first gear teeth profile, the first gear teeth profile operatively connected to the input cranking member. The second end has a plurality of first gear splines. The first gear splines are adapted and configured to slidably engage the splined end of the lead screw along the longitudinal axis.

DETAILED DESCRIPTION OF A PREFERRED EMBODIMENT

Figure 1:
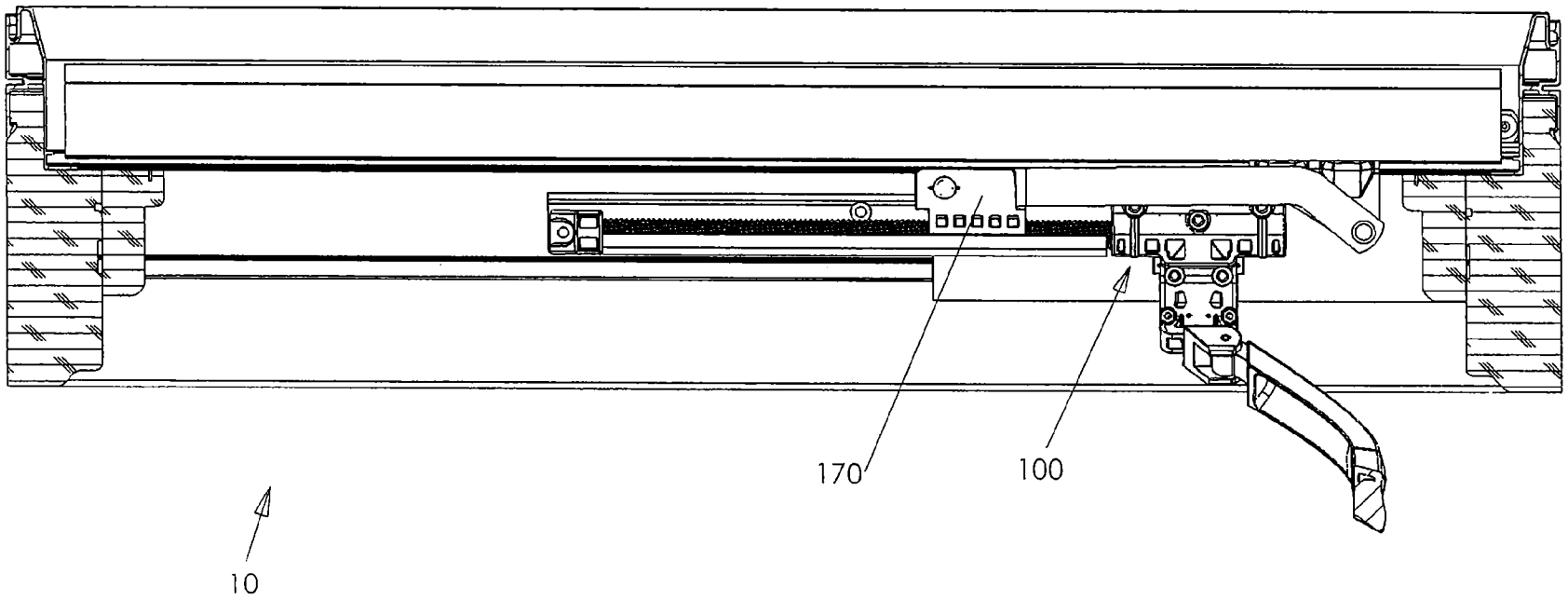
FIG. 1 is a top plan view of a lead screw operator according to the principles of the present invention installed in a window in a closed position.
Figure 2:
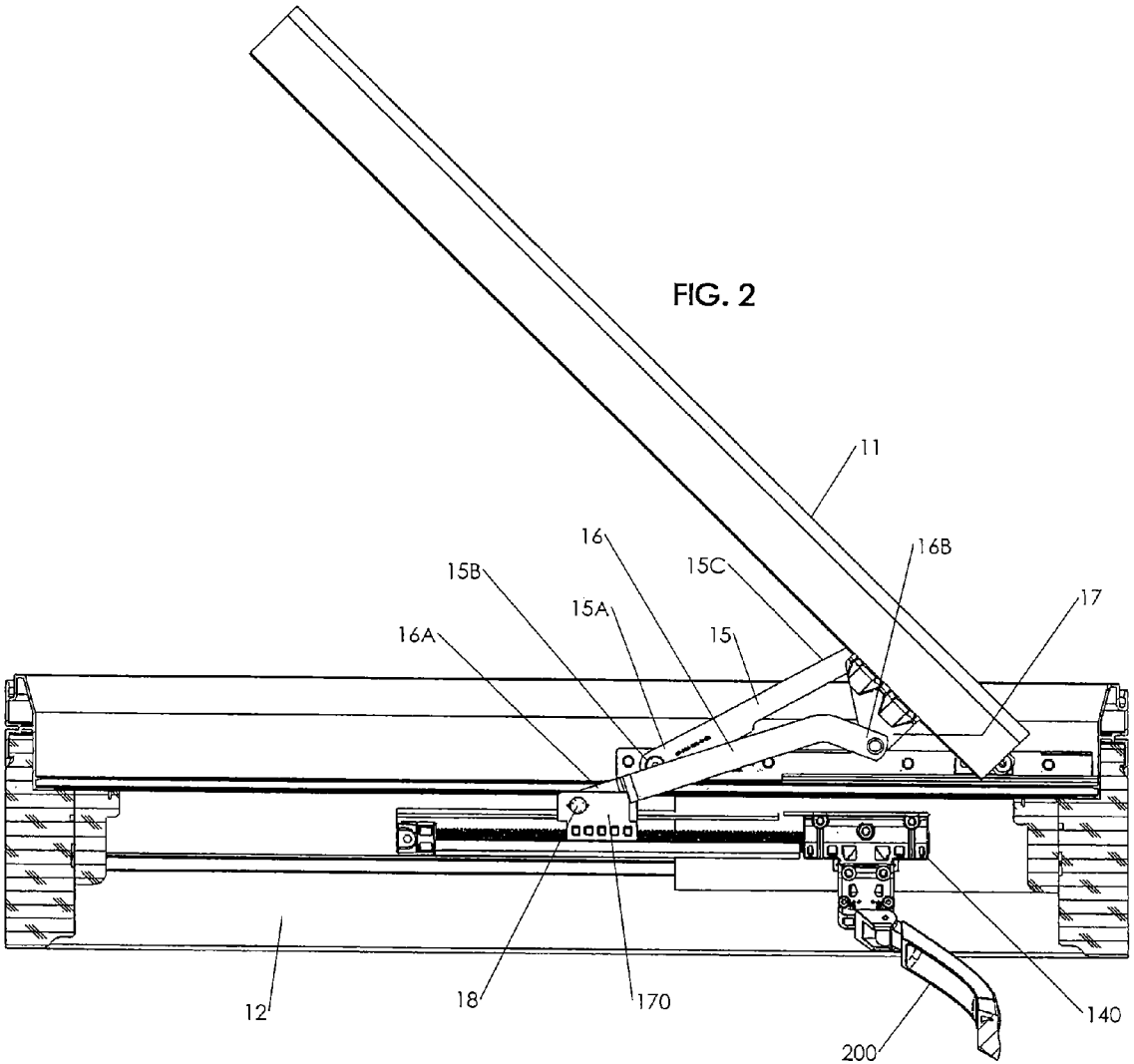
FIG. 2 is a top plan view of the lead screw operator shown in FIG. 1 in a partially open position.
Figure 3:
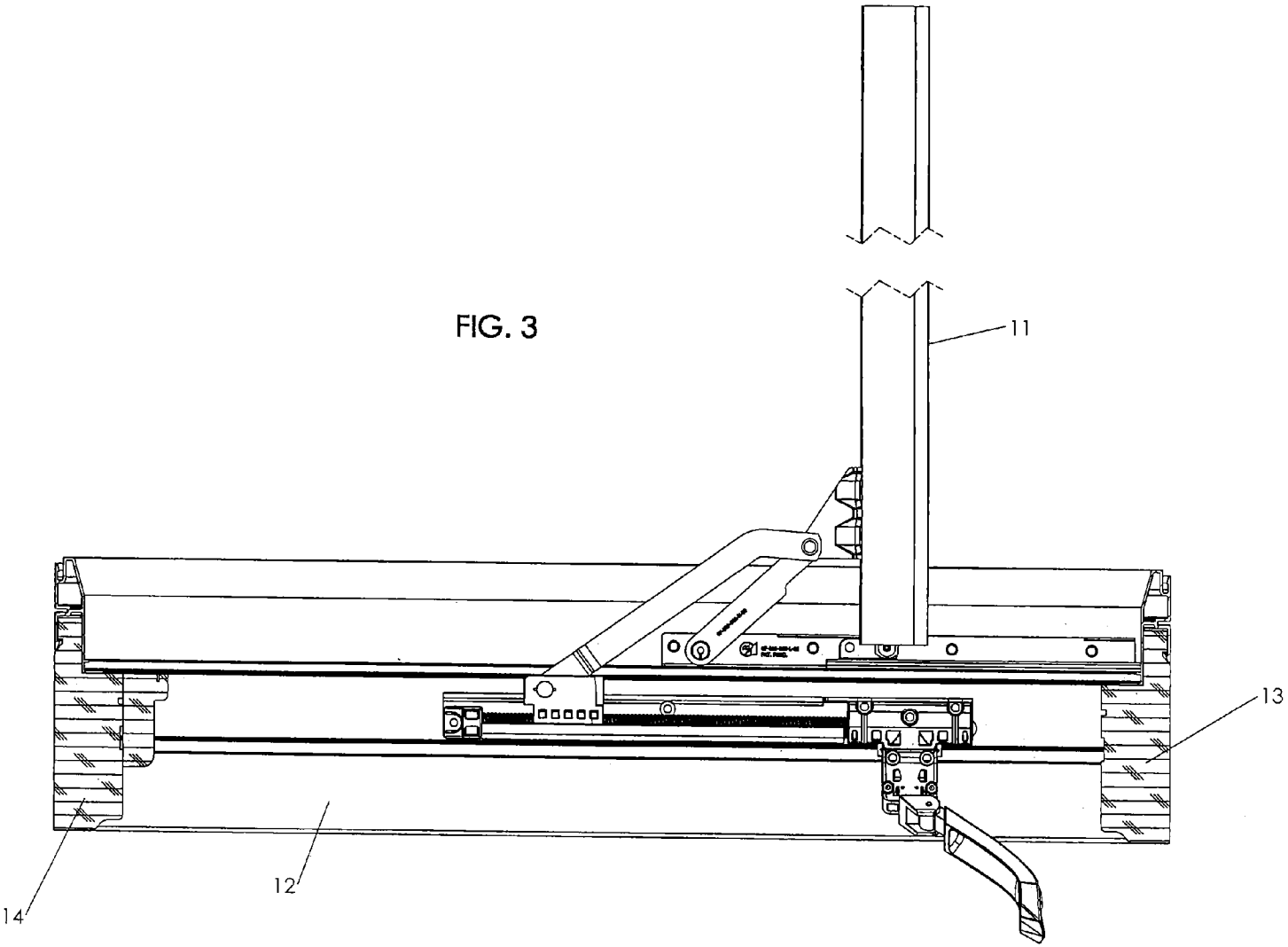
FIG. 3 is a top plan view of the operator shown in FIG. 1, in a 90 degree open position.

Referring to the drawings, wherein like numerals represent like parts throughout the several views, one embodiment of a lead screw window operator constructed according to the principles of the present invention is designated by the numeral 100. The lead screw window operator 100 is shown, in FIGS. 1-3, installed in a window assembly, generally designated as 10. The window assembly 10 is a standard casement window assembly. The assembly includes a casement window sash 11 mounted in a frame. The frame includes a bottom member 12 operatively connected to a right side member 13 and a left side member 14, by means well known in the art. Also, not shown, is a top member which would also be connected to the members 13 and 14. As most clearly seen in FIG. 2, the window sash 11 is attached to the bottom member 12 by a swivel aim 15 and a drag link 16. A first end 15*a* is secured to the bottom member 12 by means well known in the art and the swivel arm pivots about a pivot point 15*b*. The second end 15*c* of the swivel arm 15 is pivotally connected to the window sash 11 by means well known in the art. A drag link 16 has a first end 16*a* operatively connected to the lead screw window operator 100, as will be described more fully hereafter. The second end 16*b* is pivotally connected to a sash bracket 17 that is in turn secured to the window sash 11. The window sash 11 moves between the closed position as shown in FIG. 1 to a 45 degree position as shown in FIG. 2 to a 90 degree open position as shown in FIG. 3 by the lead screw window operator 100.

Figure 4:
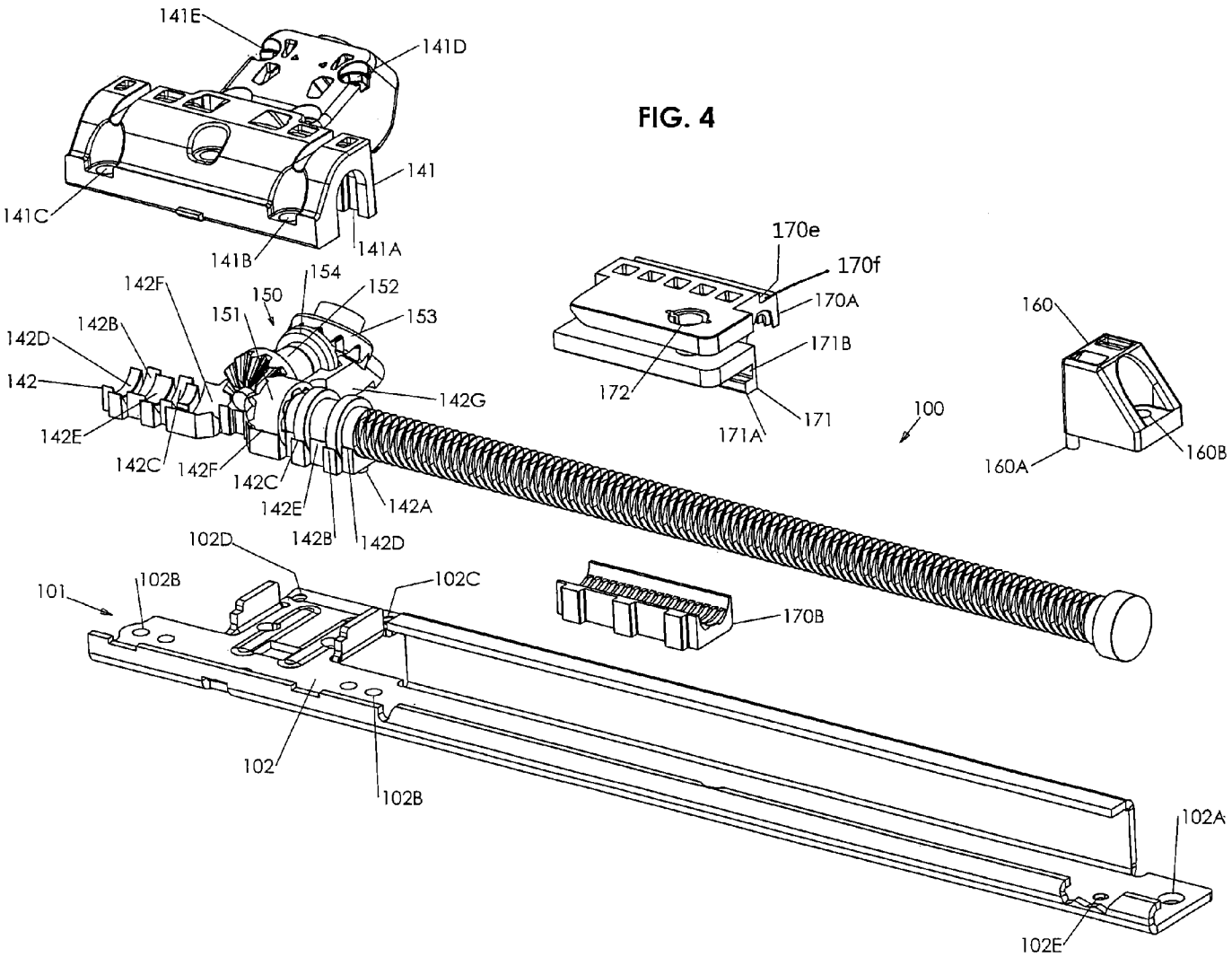
FIG. 4 is an exploded perspective view of the lead screw operator shown in FIG. 1.

Referring now to FIG. 4, there is shown an exploded view of the lead screw window operator 100. The lead screw window operator 100 includes a track 101. The track 101 includes a generally elongate rectangular planar member 102 that is fastened to the bottom member 12 by a fastening member (not shown) such as a screw through aperture 102*a*. The track 101 is further secured to the bottom member 12 through the housing 140, as will be described more fully hereafter.

A lead screw 110 is preferably non-metallic so as to save material costs and also easier manufacturing. The lead screw 110 may be made of metal, but is preferred to be made of non-metal and preferably selected from a plastic, fiberglass, ceramic or combinations thereof. Such materials allow for an inexpensive material that is easily formed into an integral lead screw. The lead screw 110 has an elongate threaded shaft 111 having a first end 111*a* and a second end 111*b*. Operatively connected to the first end 111*a* is a first collar 112 and operatively connected to the second 111*b* is a second collar 113. The first collar 112 is a dual collar and has a first portion 112*a* and a second portion 112*b*. The first and second portions 112*a* and 112*b* are discs that have an outer diameter greater than the diameter of the threaded shaft 111. Each of the portions 112*a* and 112*b* have an inside surface or stop wall 112*c* and 112*d* respectively. Separating the two portions 112*a* and 112*b* is a cylindrical member 114. Spaced from the second portion 112*b* by another cylindrical member 115 is a splined member 116. The splined member 116 has a plurality of spaced splines 116*a* around its periphery. Another cylindrical member 117 extends from the first portion 112*a* to the shaft 111. The second collar 113 has a cylindrical portion 113*a* that has an inside surface or stop wall 113*b*. Preferably, the lead screw 110, described in this paragraph, is of an integral, one-piece construction.

The housing 140 includes a first part 141 and a second part 142. The housing 140 provides support for the first collar 112 as well as support for a crank gear assembly 150 that is utilized to rotate the lead screw 110. The second part 142 has two posts 142*a*, only one of which is shown. The posts 142*a* are sized to have a friction fit in openings 102*b* in planar member 102. In viewing FIG. 4, the top portion of the right side of part 142 is obscured from view by the collar 112. However, the left side of part 142 is visible and the right side is similarly constructed. The second part 142 has two arcuate support members 142*b* and 142*c* on which the portions 112*a* and 112*b* respectively rest and rotate. Also there are arcuate support members 142*d* and 142*e* that support the cylindrical members 117 and 114 respectively. A fifth arcuate support member 142*f* is provided and supports a gear 151. As previously mentioned, the curved portion of the arcuate support members 142*b*-142*f* that support portions of the lead screw 110 are hidden from view in reviewing FIG. 4. However, their shapes can be readily seen by looking at the left side of the second part 142 as that has similar surfaces. In this embodiment, the left side is not used, although it is understood that it could be used if the lead screw was oriented in the other direction or if two lead screws were utilized.

The second part 142 also includes a section 142*g* that provides support for gears 152 and 153 as is well known in the art. The housing 140 also includes the first part 141 that is positioned over and on top of the second part 142. The first part 141 has a plurality of slots 141*a* that are sized and configured to have a friction fit with the outer portion of the arcuate support members 142*b*-142*f*. For instance, the slot labeled 141*a* in FIG. 4 has a friction fit with the outer portion of 142*b*, thereby securing the first portion 141 to the second part 142. In addition, the first part 141 has two openings 141*b* and 141*c* through which screws (not shown) are inserted and driven into the bottom member 112 to further secure the lead screw window operator to the window assembly 10. Additional openings 141*d* and 141*e* are also formed in the first part 141 and screws (not shown) are inserted through the openings 141*d* and 141*e* and also through openings 102*c* and 102*d* to further secure the lead screw window operator 100 to the bottom member 12.

The crank gear assembly 150 includes four gears 151, 152, 153 and 154. The gear 153 has a first end that has a splined bore 153*a* that is adapted and configured to receive a crank 200 as is well known in the art. The second end has a gear profile 153*b* that is sized and configured to mesh with a first gear profile 154*a* of gear 154. At the other end of the gear 154 is a bore that is sized and configured to receive an elongate shaft (not seen) of gear 152. The elongate shaft is hexagonal shaped as is the bore of gear 154. Splined or other connections may also be used. The gear 152 has a gear tooth profile 152*a* that is sized and configured to mesh with gear profile 151*b* of gear 151. Thus far described, the crank gear assembly 150 is well known in the art. However, an additional feature of the crank gear assembly 150 is the utilization of the first gear 151 that has a plurality of splines 151*a* around a bore that are sized and configured to mate with the splines 116*a* of spline member 116. As will be more fully described hereafter, this allows for longitudinal movement of the gear 151 relative to the splined member 116 when there is relative movement between the lead screw 110 and the gear 151.

Figure 11:
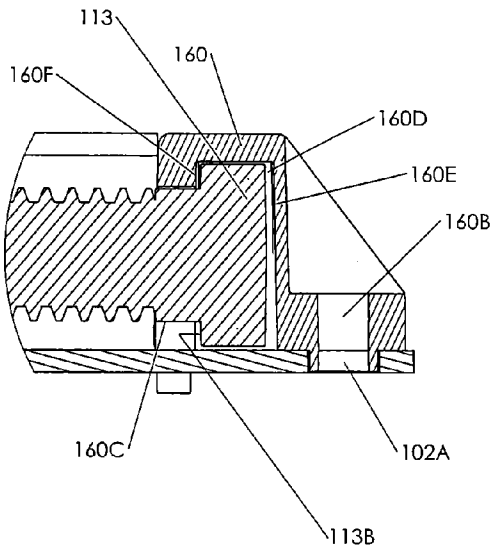
FIG. 11 is an enlarged cross-sectional view of a portion of the lead screw operator shown in FIG. 9, taken generally along the lines 11-11.

An end bearing 160 provides support for the other end of the lead screw 110. The end bearing 160 has a bottom post 160*a* that is sized and configured to have a friction fit with opening 102*e* in the planar member 102. In addition, the end bearing 160 has an opening 160*b* that is in alignment with opening 102. A screw (not shown) is secured through both openings 160*b* and 102*a* to further secure the end bearing 160 in position as well as to hold the planar member 102 in position on the bottom member 12. As best seen in FIG. 11, the second collar 113 is captured and supported inside of the end bearing 160. The bottom of the end bearing 160 is open to receive the collar 113. The end bearing housing forms a support surface 160*c* that is arcuate in shape and supports the cylindrical member 118 that is positioned between the threaded shaft 111 and the collar 113. An inner cavity 160*d* is defined longitudinally by end wall 160*e* and 160*f*. The cavity 160*d* is slightly larger than the width of the cylindrical portion 113*a* to allow for longitudinal movement.

Figure 10:
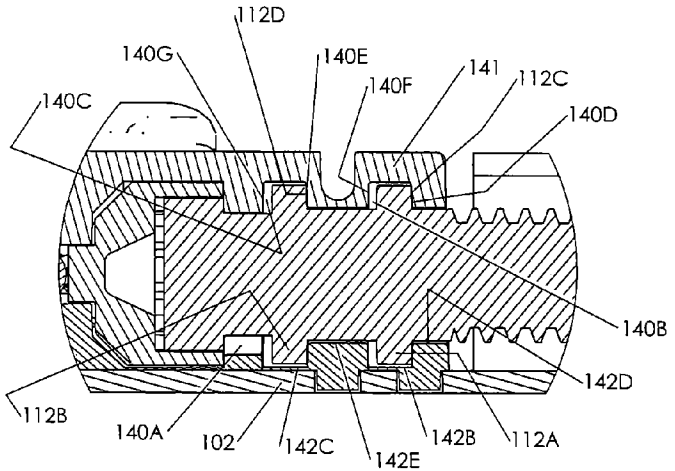
FIG. 10 is an enlarged cross-sectional view of the lead screw operator shown in FIG. 9, taken generally along the lines 10-10.

Referring now to FIG. 10, it can be seen more easily how the housing 140 captures and supports the first collar 112. The housing 140 forms a cavity or enclosure 140*a* in which the collar 112 is captured. The housing cavity 140*a* has a first collar cavity 140*b* in which the first portion 112*a* is positioned and a second collar cavity 140*c* in which the second portion 112*b* is positioned. The collar cavities 140*b* and 140*c* have inside end walls 140*d* and 140*e* respectively.

Therefore, it can be seen that the lead screw support structure in the present invention is the housing 140 which provides an inboard bearing, the track 101 and the end bearing 160. In order to have the lead screw in tension, the stop surfaces in the housing and end bearing must be toward the center of the lead screw 110 so that the collars 112 and 113 are outside of the stop surfaces and the lead screw is held in tension when the lead screw is moving in both directions.

Figure 5:
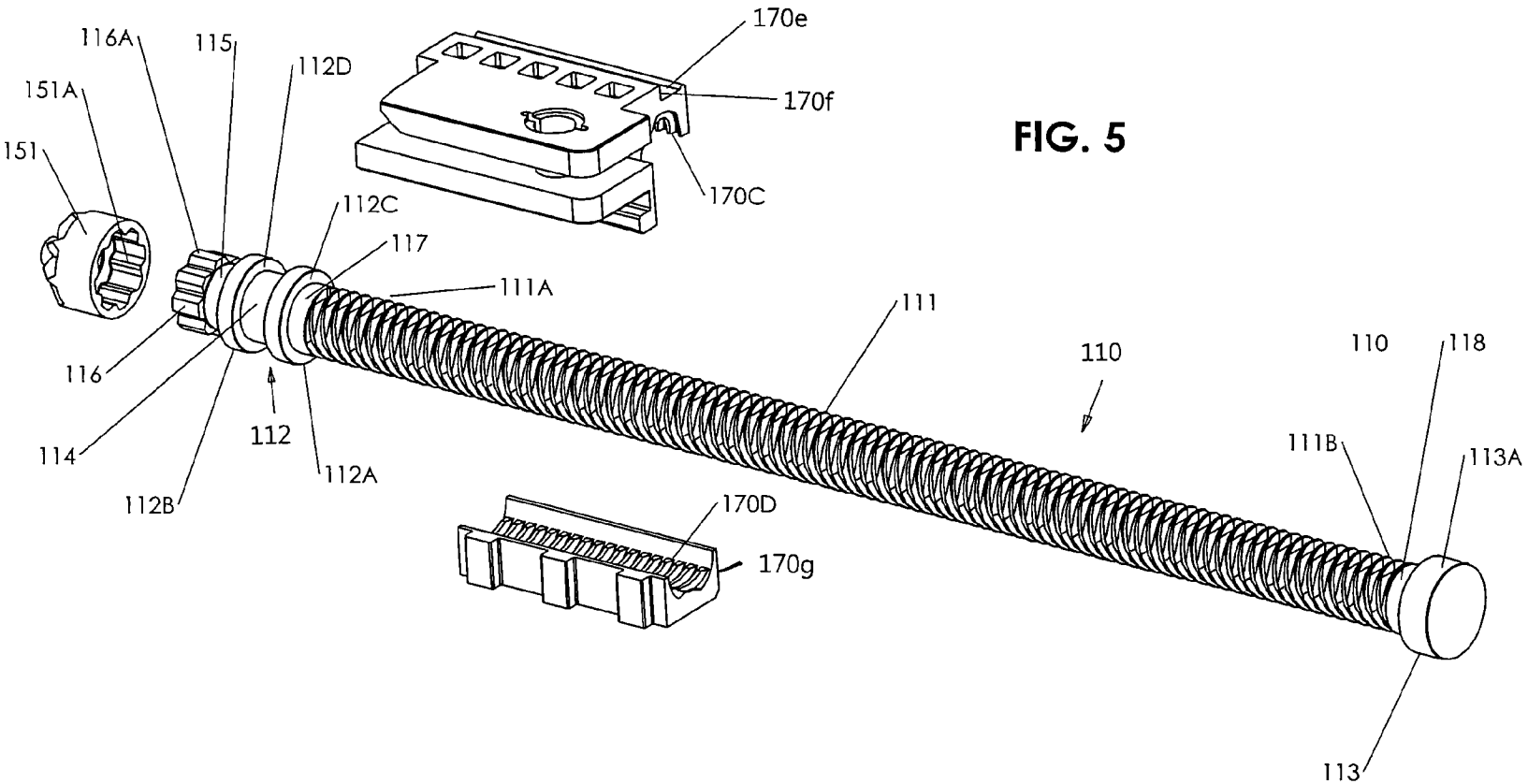
FIG. 5 is an exploded perspective view of a portion of the lead screw operator shown in FIG. 1.
Figure 6:
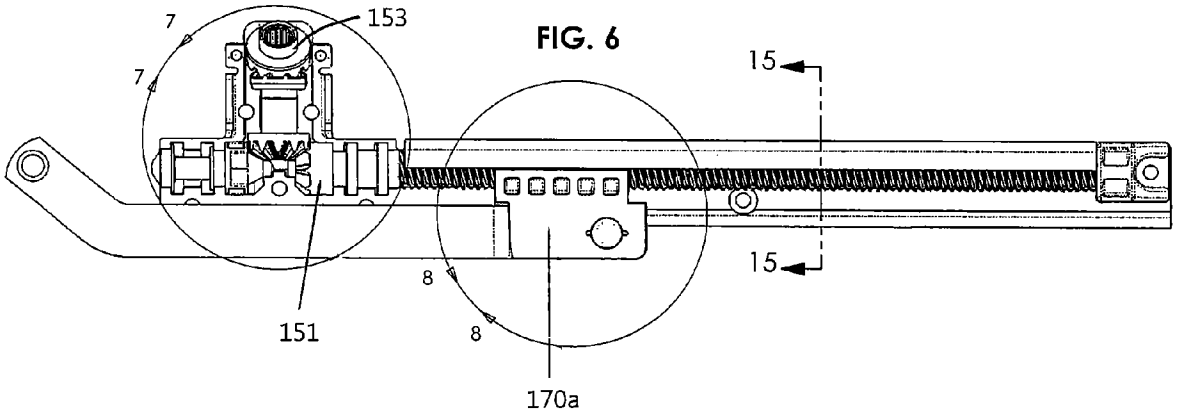
FIG. 6 is a top plan view of the lead screw operator shown in FIG. 1, removed from a window.
Figure 8:
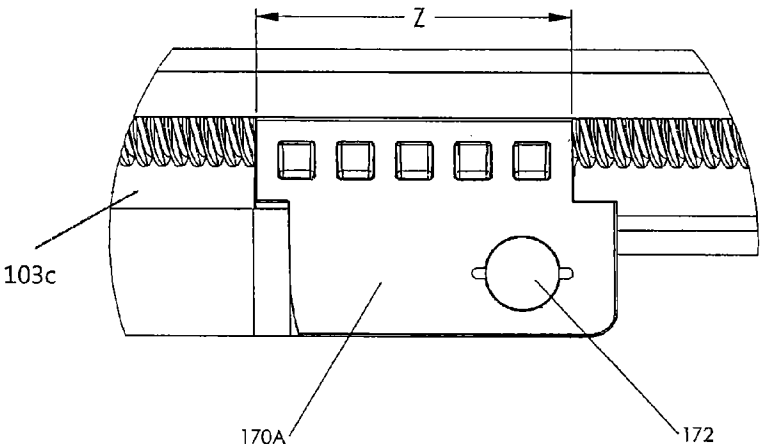
FIG. 8 is an enlarged view of a portion of the lead screw operator shown in FIG. 6, taken generally along the lines 8-8.
Figure 7:
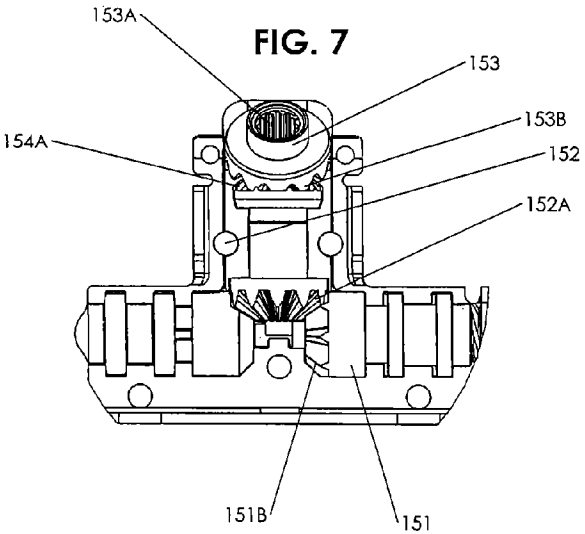
FIG. 7 is an enlarged view of the lead screw operator shown in FIG. 6, taken generally along the lines of 7-7.
Figure 9:
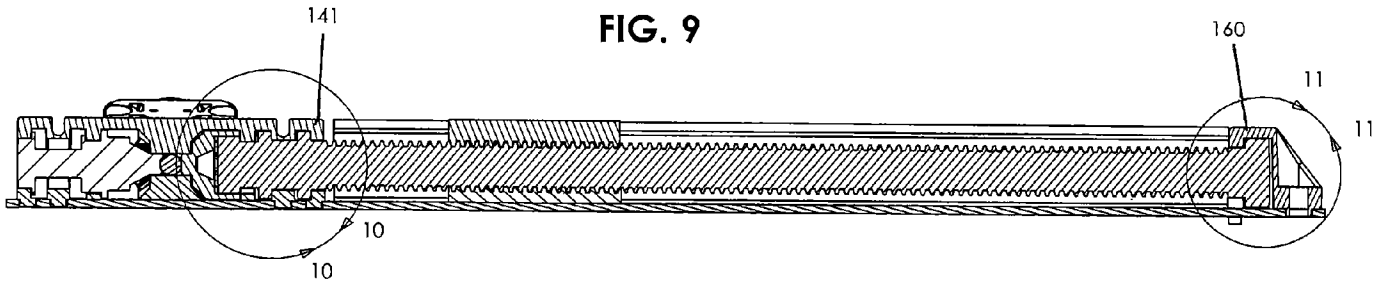
FIG. 9 is a cross-sectional view of the lead screw operator shown in FIG. 1.

Referring now to FIGS. 4 and 5, there is shown the split nut 170. The split nut 170 includes a top portion 170*a* operatively connected to a bottom section 170*b*. The portions 170*a* and 170*b* have thread sections 170*c* and 170*d* that, when assembled, form a threaded path for the shaft 111. Since the diameter of the second collar 113 is greater than the diameter of the threaded shaft 111, it is necessary that the nut be split to assemble the nut on the shaft. While not shown, it is understood that the portions 170*a* and 170*b* may be suitably connected by means well known in the art, such as having corresponding openings in each of the portions 170*a* and 170*b* and then inserting a pin into the openings to form a friction fit and thereby assemble the nut 170 around the shaft 111. The nut 170 is designed to slide on the track 101. In addition to having the planar member 102, the track 101 includes a rear lip 103 that includes a back wall 103*a*, which has an inside planar surface 103*d*, and an overhang member 103*b*. The overhang 103*b* has a flat surface 103*c*. At the front portion of the planar member 102 is a generally vertical upright wall 104, which has an inside planar surface 104*a*. An overhang member 105 generally extends 90 degrees from the upright wall 104 and the overhang has a flat surface 105*a*. The planar surfaces 103*d* and 104*a* provide for support surfaces for the nut 170, as will be described more fully hereafter.

The top portion 170*a* has lower lip 171 that has a protrusion 171*a* that is designed and configured to be positioned under the overhang 103*b*. The lower lip 171 has a generally planar flat surface 171*b* that forms an edge that is positioned proximate the flat surface 103*c*. A vertical surface 171*c* is formed at the end of the lower lip 171 and is proximate surface 103*d*. The top portion 170*a* has an L-shaped cutout toward the front that has a planar bottom surface 170*e* and a 90 degree planar upright surface 170*f*. The planar upright surface 170*f* is sized and configured to be proximate the flat surface 105*a*. The bottom portion 170*b* has a vertical surface 170*g* that is proximate the surface 104*a*.

Figure 12:
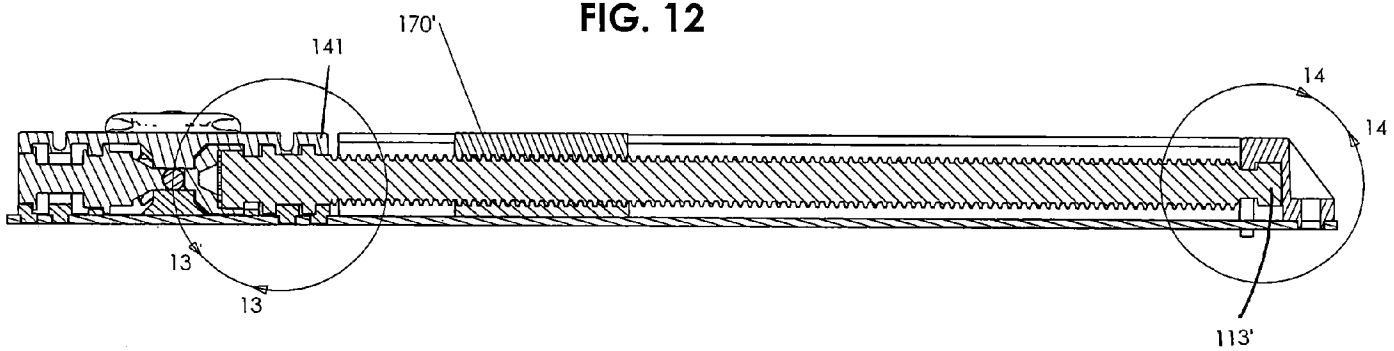
FIG. 12 is a cross-sectional view of another embodiment of a lead screw operator.
Figure 14:
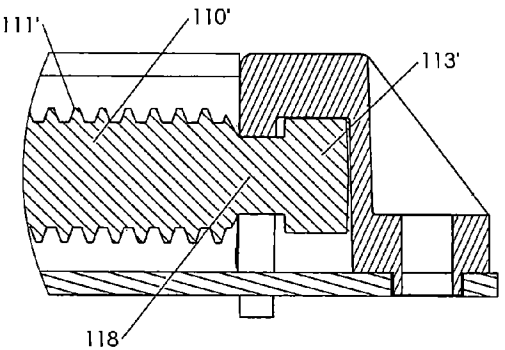
FIG. 14 is an enlarged perspective view of a portion of the lead screw operator shown in FIG. 12, taken generally along the lines 14-14.
Figure 13:
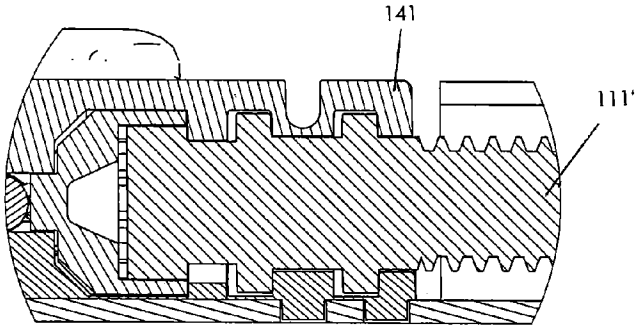
FIG. 13 is an enlarged cross-sectional view of a portion of the lead screw operator shown in FIG. 12, taken generally along the lines 13-13.
Figure 15:
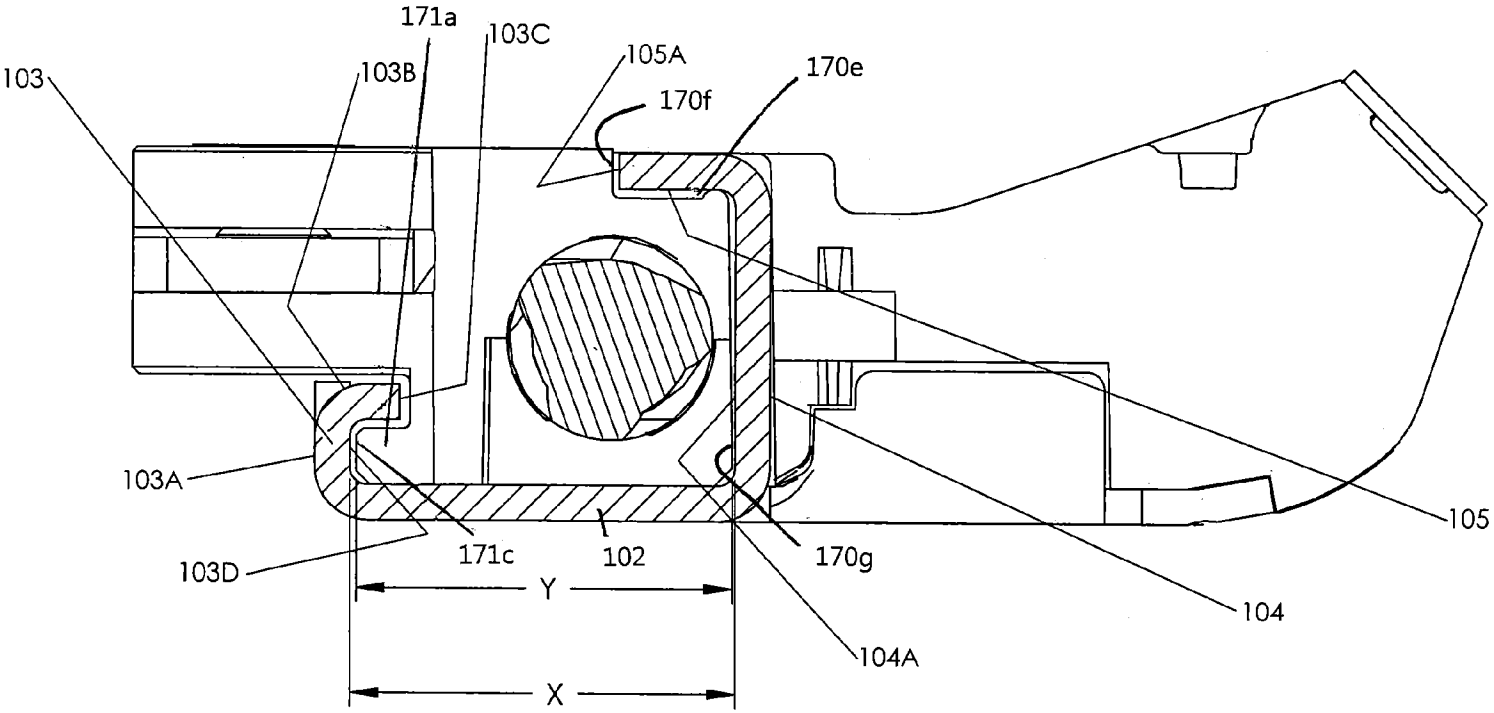
FIG. 15 is a cross-sectional view of the nut and track shown in FIG. 4.

A second embodiment of the invention is shown in FIGS. 12-13. A lead screw 110' is shown that has a smaller diameter second collar 113'. The diameter of the collar 113' is less than the diameter of the threaded shaft 111'. Because the diameter of the collar 113' is smaller than the threaded shaft 111', it is possible to use a nut 170' that is not split. The nut 170' is able to be an integral component as the collar 113' will be able to fit through the nut 170'. Otherwise, the remainder of the second embodiment is identical to that shown in the first embodiment.

As previously discussed, the first end 16*a* of the drag link 16 is operatively connected to the split nut by suitable means such as a bolt 18 being inserted through an aperture in the drag link 16 and through an aperture 172 in the nut 170. This is well known in the art. Then, in operation, the casement window 11 is moved between an open and closed position as shown in FIGS. 1-3 by rotation of the crank 200. Rotation of the crank 200 in turn causes rotation of the gear 153 thereby turning gear 154 which in turn rotates gear 152, which in turn rotates gear 151. The splines 151*a* of gear 151 in turn mate with the spline 116*a* which results in rotation of the lead screw 110. Since the lead screw 110 is captured by the housing 140 and the end bearing 160, the lead screw, except for minor longitudinal movement, is stationary and it is the nut 170 that moves because of the rotation of the lead screw 110.

As shown in the sequence of FIGS. 1-3, the opening of the casement window 11 is shown and results when the nut 170 is moved away from the crank 200. Closing of the window would be shown in the sequence of FIG. 3 to FIG. 1. The opening or closing is a result of the rotation of the lead screw 110. The initial rotation of the lead screw 110 will result in the lead screw 110 moving in the direction opposite of the nut 170. However, the lead screw 110 is then almost immediately constrained by the housing 140 or end bearing 160, depending on the direction of travel. The closing position is shown in FIGS. 10 and 11 in more detail.

As viewed in FIGS. 10 and 11 (where right and left are reversed from FIGS. 1-3), as the window is closed, the lead screw 110 will initially move to the right along its longitudinal axis. The housing 140 will stop the movement of the lead screw 110 and the nut 170 will move toward the crank. The housing 140 will stop the movement of the lead screw 110 and the nut 170 will move. When the housing 140 stops the movement, the collar 112 is designed to contact the housing 140 in such a manner as to keep the lead screw 110 in tension as it is being closed. Specifically, the stop walls 112*c* and 112*d* of the first portions 112*a* and 112*b* respectively will contact the end walls 140*d* and 140*e* before the collar 113 contacts the end bearing 160. The inner cavity 160*d* is sized so that there is sufficient room between the end of the collar 113 and the end of the wall 160*e* so that they do not make contact during the closing operation. It can therefore be seen that the lead screw 110 is always in tension and is such is stronger and not as susceptible to bending, buckling or breaking. Because it is always in tension, it is possible to have the lead screw made out of a non-metallic material.

As the window is being opened, as shown in FIGS. 1-3, the nut is being moved away from the crank 200 and the lead screw 110 is being moved toward the crank. In this condition, the stop wall 113*b* will contact the end wall 160*f* before the portions 112*a* and 112*b* contact the end walls 140*f* and 140*g* of the housing 140. This will result in the lead screw being in tension when the casement window 11 is being opened. The end walls 140*f* and 140*g* are positioned such that the collar 113 will contact the end wall 160*f* before the first portions 112*a* and second portion 112*b* contact the housing end walls 140*f* and 140*g*.

As the operation has been described thus far, it is clear that the lead screw 110 is relatively stationary along its longitudinal axis. However, there is some movement along the longitudinal axis before the collars either 112 or 113 move to contact their respective end walls. Because the gear 151 is operatively connected to the spline members 116*a* via splines 151*a*, the lead screw 110 is able to stay in good rotational contact with the gear 151 during this small longitudinal movement and not move gear 151 along a longitudinal axis so as to not affect the contact between the gear profile 151*b* and the second gear profile 152*a*.

In addition to tension forces that are placed on the lead screw, the nut may also transmit side forces to the lead screw as the casement window is being opened and closed. The present invention transfers these side forces to the track. As was previously described, the nut 170 has two edges or surfaces 171*c* and 170*g* that, upon transmitting side forces, contact one of the two edges on the track 103*d* and 104*a*. By having the nut 170 have a sufficient length along these surfaces as well as having a close tolerance on the width of the nut compared to the distance between the two contacting surfaces on the track, one is able to have the nut 170 take the side loads without transmitting them to the lead screw 110. By having the distance X, the distance between the width of the surfaces on the side track being just slightly greater than the distance Y, the width of the nut 170 between its contacting surfaces, one is able to limit the amount of rotation of the nut 170 about a vertical axis. This also has to be in conjunction with the length of the nut. The tighter the tolerance, i.e. the smaller the distance between X-Y, the less length the nut 170 has to have in order to prevent rotation. It is preferable that the rotation of the nut be limited to 2 degrees or less and preferably 1.5 degrees or less, and more preferably 1.2 degrees or less. In the embodiment shown in the figures, the length of the nut is Z inches. The distance X is 1.031 inches and the distance Y is 1.0 inches. Therefore it can be seen that the clearance between the width of the nut and the track is 0.031 inches. The length of the nut is 1.5 inches. With these parameters, the rotation about a vertical axis is limited to 1.2 degrees.

It is also understood that the nut does not have to have its outside edges contact the track, but could have a slot down the middle to define the two edges of contact with the track.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A lead screw window operator for moving a window sash between an open and closed position relative to a fixed window frame, the lead screw window operator comprising:

(a) a lead screw support structure;

(b) a lead screw operatively supported on the lead screw support structure, the lead screw having a longitudinal axis;

(c) the lead screw having a first collar operatively connected to a first end of the lead screw, and a second collar operatively connected to a second end of the lead screw;

(d) the collars each having an inside edge;

(e) a nut positioned around the lead screw, wherein rotation of the lead screw results in movement of the nut along the longitudinal axis of the lead screw; and (f) the lead screw support structure having first and second cavities to receive the first and second collars, the cavities each having an inside stop wall, the collars inside edges are positioned outside of their respective stop walls, wherein rotational movement of the lead screw in either direction along the longitudinal axis results in movement of the nut and places the lead screw in tension when the one of the inside edges contacts the one of the inside stop walls.

2. The lead screw window operator of claim 1, wherein the lead screw is nonmetallic.

3. The lead screw window operator of claim 2, wherein the lead screw is nonmetallic and selected from the group consisting of plastic, fiberglass, ceramics and combinations thereof.

4. The lead screw window operator of claim 2, further comprising the lead screw and collars are integral.

5. The lead screw window operator of claim 1 further comprising:

(a) the nut having a front edge and a back edge, both edges generally parallel to the longitudinal axis;

(b) the lead screw support structure having a generally planar base and a first support surface extending upward from the base and generally parallel to the longitudinal axis;

(c) the first support surface positioned proximate to one of the edges; and (d) a second support surface extending upward from the base and generally parallel to the longitudinal axis, the second support surface positioned proximate the other of the edges sufficiently close which, along with the first support surface, prevents rotation of the nut to 2 degrees or less.

6. The lead screw window operator of claim 5, wherein rotation of the nut is limited to 1.5 degrees or less.

7. The lead screw window operator of claim 6, wherein rotation of the nut is limited to 1.2 degrees or less.

8. The lead screw window operator of claim 1, further comprising:

(a) a splined end operatively connected to a first end of the lead screw, the splined end having a plurality of splines; and (b) a first gear operatively connected to an input cranking member, the first gear having a first end and a second end, the first end having a first gear teeth profile, the first gear teeth profile operatively connected to the input cranking member, the second end having a plurality of first gear splines, the first gear splines adapted and configured to slidably engage the splined end of the lead screw along the longitudinal axis.

9. The lead screw window operator of claim 5, further comprising:

(a) a splined end operatively connected to a first end of the lead screw, the splined end having a plurality of splines; and (b) a first gear operatively connected to an input cranking member, the first gear having a first end and a second end, the first end having a first gear teeth profile, the first gear teeth profile operatively connected to the input cranking member, the second end having a plurality of first gear splines, the first gear splines adapted and configured to slidably engage the splined end of the lead screw along the longitudinal axis.

10. A lead screw window operator of claim 1, further comprising:

(a) a splined end operatively connected to a first end of the lead screw, the splined end having a plurality of splines; and (b) a first gear operatively connected to an input cranking member, the first gear having a first end and a second end, the first end having a first gear teeth profile, the first gear teeth profile operatively connected to the input cranking member, the second end having a plurality of first gear splines, the first gear splines adapted and configured to slidably engage the splined end of the lead screw along the longitudinal axis.

11. The lead screw window operator of claim 10, wherein the lead screw is nonmetallic.

12. The lead screw window operator of claim 11, wherein the lead screw is nonmetallic selected from the group consisting of plastic, fiberglass, ceramics and combinations thereof.

13. The lead screw window operator of claim 12, wherein the first gear is fixed in the longitudinal direction and the lead screw having the nut positioned around the lead screw and the nut moves in the longitudinal direction.

14. The lead screw operator of claim 12, further comprising the first gear having a central bore and the plurality of splines position around the bore.

* * * * *